US009545535B2

(12) United States Patent
Lagree

(10) Patent No.: US 9,545,535 B2
(45) Date of Patent: Jan. 17, 2017

(54) EXERCISE MACHINE INCLINATION DEVICE

(71) Applicant: SPX Fitness, Inc, Burbank, CA (US)

(72) Inventor: Sebastien Anthony Louis Lagree, West Hollywood, CA (US)

(73) Assignee: Lagree Technologies, Inc., Burbank, CA (US)

( * ) Notice: Subject to any disclaimer, the term of this patent is extended or adjusted under 35 U.S.C. 154(b) by 0 days.

(21) Appl. No.: 15/041,028

(22) Filed: Feb. 10, 2016

(65) Prior Publication Data

US 2016/0166870 A1 Jun. 16, 2016

Related U.S. Application Data

(63) Continuation-in-part of application No. 14/725,908, filed on May 29, 2015, now Pat. No. 9,370,679, which
(Continued)

(51) Int. Cl.
*A63B 24/00* (2006.01)
*A63B 21/00* (2006.01)
(Continued)

(52) U.S. Cl.
CPC ... *A63B 21/00069* (2013.01); *A63B 21/00065* (2013.01); *A63B 21/0428* (2013.01);
(Continued)

(58) Field of Classification Search
CPC ..... A63B 21/00069; A63B 21/0083; A63B 21/0087; A63B 21/0552; A63B 21/0428; A63B 21/00076; A63B 21/00065; A63B 22/0087; A63B 22/0076; A63B 22/02; A63B 22/0605; A63B 22/0664; A63B 24/0084; A63B 24/0087; A63B 24/00; A63B 24/0062; A63B 22/0214; A63B 22/0007; A63B 22/0023
See application file for complete search history.

(56) References Cited

U.S. PATENT DOCUMENTS 1,866,868 A 7/1932 Thomson
4,240,627 A 12/1980 Brentham
(Continued)

FOREIGN PATENT DOCUMENTS

EP 0354785 2/1990

OTHER PUBLICATIONS http://www.walmart.com/ip/total-gym-1400/23816097?adid=15000000000000027727770; Webpage from Walmart.com for the Total Gym 1400; Received and Printed Aug. 25, 2014.
PCT International Search Report and Written Opinion; Received and Downloaded on Sep. 1, 2015.

*Primary Examiner* — Glenn Richman
(74) *Attorney, Agent, or Firm* — Neustel Law Offices; Michael S. Neustel

(57) ABSTRACT

An exercise machine inclination device for providing variable exercise intensity on an exercise machine by inclining the exercise machine. The exercise machine inclination device generally includes a base adapted for being positioned upon a floor, a support structure adapted for supporting an exercise machine, a hinge pivotally connecting the base and the support structure and an actuator connected between the base and the support structure, wherein the actuator adjusts an angle of the support structure.

28 Claims, 14 Drawing Sheets

Related U.S. Application Data is a continuation-in-part of application No. 14/468,958, filed on Aug. 26, 2014, now Pat. No. 9,211,440.

(60) Provisional application No. 62/004,936, filed on May 30, 2014, provisional application No. 61/869,904, filed on Aug. 26, 2013, provisional application No. 62/114,338, filed on Feb. 10, 2015.

(51) Int. Cl.

| | |
|---|---|
| ***A63B 21/04*** | (2006.01) |
| *A63B 22/00* | (2006.01) |
| *A63B 21/008* | (2006.01) |
| *A63B 21/055* | (2006.01) |
| *A63B 22/02* | (2006.01) |
| *A63B 22/06* | (2006.01) |

(52) U.S. Cl.

CPC ..... *A63B 24/0084* (2013.01); *A63B 24/0087* (2013.01); *A63B 21/00076* (2013.01); *A63B 21/0083* (2013.01); *A63B 21/0087* (2013.01); *A63B 21/0552* (2013.01); *A63B 22/0076* (2013.01); *A63B 22/0087* (2013.01); *A63B 22/02* (2013.01); *A63B 22/0605* (2013.01); *A63B 22/0664* (2013.01); *A63B 2024/0093* (2013.01); *A63B 2208/0204* (2013.01); *A63B 2208/0242* (2013.01); *A63B 2225/50* (2013.01)

(56) References Cited

U.S. PATENT DOCUMENTS

| | | | | |
|---|---|---|---|---|
| 4,759,540 | A * | 7/1988 | Yu | A63B 22/0023 482/54 |
| 5,782,639 | A * | 7/1998 | Beal | A63B 71/0622 434/29 |
| 5,820,478 | A | 10/1998 | Wood | |
| 5,895,340 | A | 4/1999 | Keller | |
| 6,179,753 | B1 * | 1/2001 | Barker | A63B 22/0214 482/51 |
| 7,270,628 | B2 * | 9/2007 | Campanaro | A63B 21/068 482/103 |
| 7,935,032 | B1 | 5/2011 | Jackson | |
| 8,012,073 | B2 | 9/2011 | Barnett | |
| 2002/0022551 | A1 | 2/2002 | Watterson | |
| 2004/0077464 | A1 | 4/2004 | Feldman | |
| 2004/0248710 | A1 | 12/2004 | Rodgers, Jr. | |
| 2006/0172862 | A1 | 8/2006 | Badarneh | |
| 2006/0211543 | A1 * | 9/2006 | Feldman | A63B 22/0007 482/57 |
| 2006/0293156 | A1 | 12/2006 | Trees | |
| 2008/0242511 | A1 | 10/2008 | Munoz | |
| 2009/0023556 | A1 | 1/2009 | Daly | |
| 2011/0082016 | A1 | 4/2011 | Kim | |
| 2011/0152032 | A1 | 6/2011 | Barnett | |
| 2012/0071301 | A1 | 3/2012 | Kaylor | |
| 2012/0088634 | A1 | 4/2012 | Heidecke | |
| 2013/0150219 | A1 | 6/2013 | Chang | |

* cited by examiner

EXERCISE MACHINE INCLINATION DEVICE

CROSS REFERENCE TO RELATED APPLICATIONS

The present application is a continuation-in-part of U.S. application Ser. No. 14/725,908 filed on May 29, 2015, which is a continuation-in-part of U.S. application Ser. No. 14/468,958 filed on Aug. 26, 2014 now issued as U.S. Pat. No. 9,211,440 and claims priority to U.S. Provisional Application No. 62/004,936 filed May 30, 2014, which claims priority to U.S. Provisional Application No. 61/869,904 filed Aug. 26, 2013.

I also hereby claim benefit under Title 35, United States Code, Section 119(e) of U.S. provisional patent application Ser. No. 62/114,338 filed Feb. 10, 2015.

Each of the aforementioned patent applications, and any applications related thereto, is herein incorporated by reference in their entirety.

STATEMENT REGARDING FEDERALLY SPONSORED RESEARCH OR DEVELOPMENT

Not applicable to this application.

BACKGROUND

Field

Example embodiments in general relate to an exercise machine inclination device for providing variable exercise intensity on an exercise machine by inclining the exercise machine. In one embodiment, a Pilates exercise machine is rapidly inclined at one end concurrently while an exerciser is performing exercises.

Related Art

Any discussion of the related art throughout the specification should in no way be considered as an admission that such related art is widely known or forms part of common general knowledge in the field.

Contemporary Pilates apparatuses are well known throughout the fitness industry, and have remained true to the core designs introduced by originator Joseph Pilates in the early 1900s. Pilates apparatuses are generally comprised of a rectangular, horizontal base structure with parallel rails aligned with the major length axis of the rectangular structure, and a slidable carriage thereupon that is attached to one end of the structure by springs or elastic bands that produce a resistance bias. Moving the slidable carriage horizontally and along the rails in a direction opposite the end of the apparatus to which the spring resistance is attached creates a workload against which therapeutic or fitness exercises can be performed.

SUMMARY

An example embodiment of the exercise machine inclination device is directed to an exercise machine inclination device. The exercise machine inclination device includes a base adapted for being positioned upon a floor, a support structure adapted for supporting an exercise machine, a hinge pivotally connecting the base and the support structure and an actuator connected between the base and the support structure, wherein the actuator adjusts an angle of the support structure.

There has thus been outlined, rather broadly, some of the features of the exercise machine inclination device in order that the detailed description thereof may be better understood, and in order that the present contribution to the art may be better appreciated. There are additional features of the exercise machine inclination device that will be described hereinafter and that will form the subject matter of the claims appended hereto. In this respect, before explaining at least one embodiment of the exercise machine inclination device in detail, it is to be understood that the exercise machine inclination device is not limited in its application to the details of construction or to the arrangements of the components set forth in the following description or illustrated in the drawings. The exercise machine inclination device is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Example embodiments will become more fully understood from the detailed description given herein below and the accompanying drawings, wherein like elements are represented by like reference characters, which are given by way of illustration only and thus are not limitative of the example embodiments herein.

DETAILED DESCRIPTION

Figure 1:
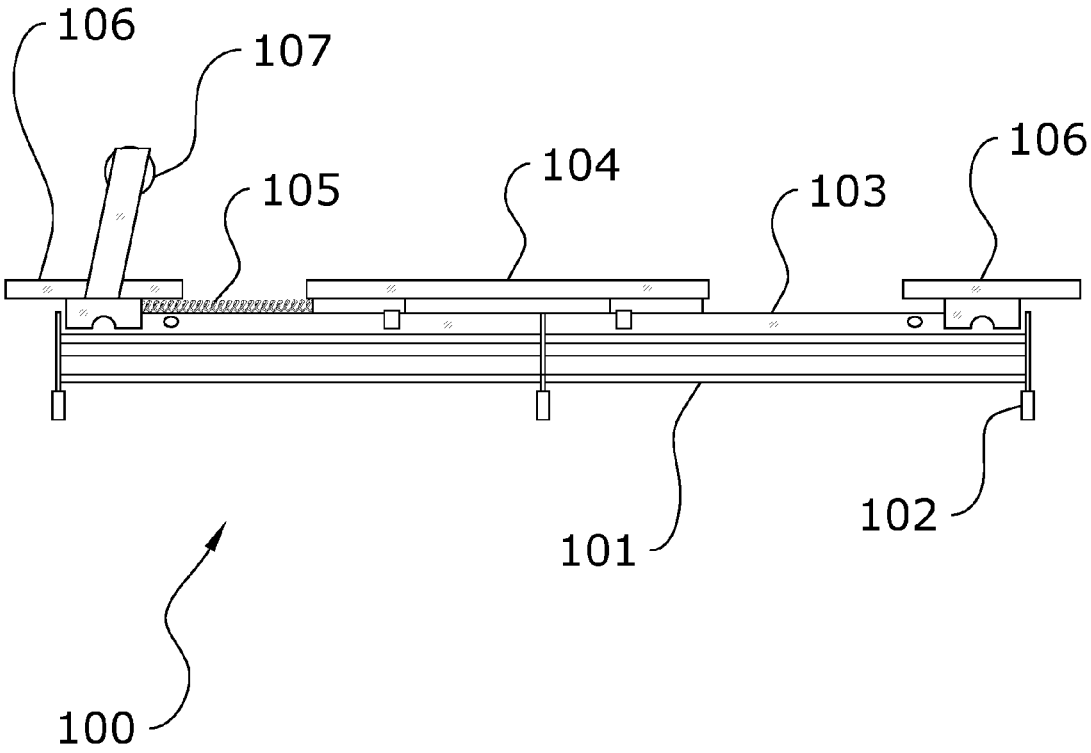
FIG. 1 is an exemplary diagram showing the side view of a traditional Pilates apparatus.

FIG. 1 is an exemplary diagram showing the side view of a traditional Pilates apparatus. More specifically, the drawing shows an exemplary illustration of the side view of a representative Pilates apparatus 100 comprising a structural frame 101 extending the substantial length of the longitudinal axis of the apparatus between the distal ends upon which exercise platforms 106 are affixed. The structural frame is supported off of the floor by a plurality of supporting legs 102. The operational components of a traditional Pilates apparatus typically include one pair of parallel rails 103 extending substantially the length of the apparatus, a slidable carriage mounted upon the rails, and one or more springs 105 or other removably attached biasing means connecting the slidable carriage to one stationary end of the structural frame.

As just one of many exercise examples, when an exerciser not shown is positioned with their back placed upon the horizontal surface of the slidable carriage 104, and their feet placed upon the push bar 107 affixed to the stationary end of the apparatus, they may exercise by pushing with their feet against the push bar with sufficient force to overcome the spring tension between the slidable carriage and stationary end of the support frame. By using muscle force to overcome the resistance level of the spring biasing means, the slidable carriage slides along the parallel rails in a direction opposite of the force exerted by the exerciser's feet. Upon full extension of their legs, the exerciser returns the slidable platform to the starting position, thereby completing one repetition of the exercise. Most exercises require the completion of multiple repetitions.

Now then, if, prior to exercising, the exerciser attached a plurality of springs between the slidable carriage and structural frame such that the cumulative spring resistance force was 50 pounds, each time they completed a repetition, they would have exercised with a force just over 50 pounds. The resistance level would not change between each repetition without stopping the exercise, and removing or attaching additional springs.

Those skilled in the art will appreciate that this is the traditional Pilates method of exercising on a Pilates apparatus, and will further appreciate the exerciser's limitation of not being able to change the resistance force during the performance of an exercise.

Figure 2:
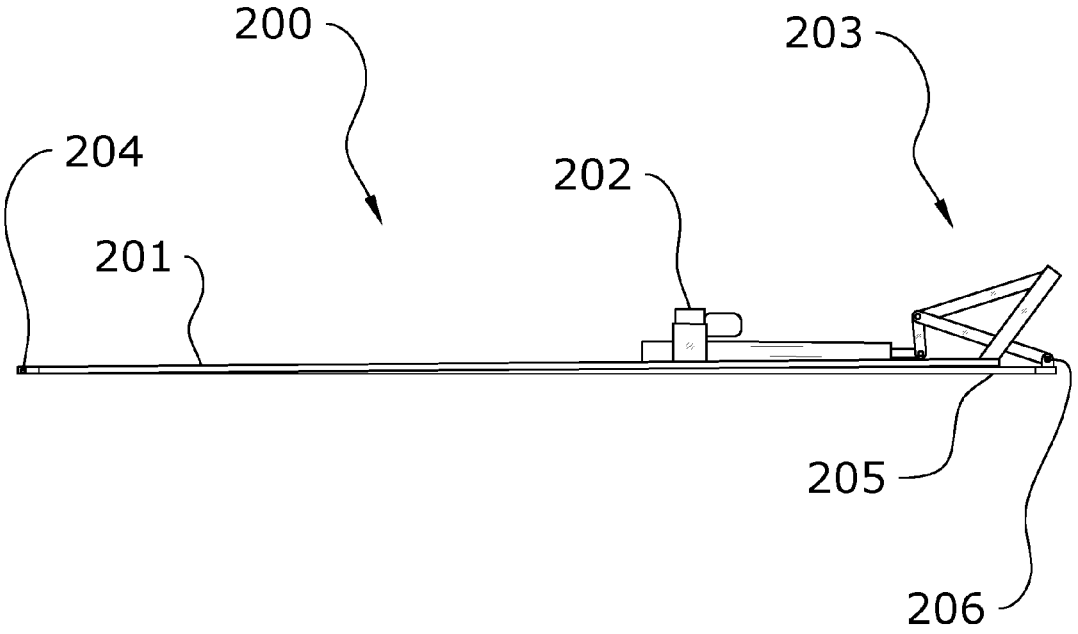
FIG. 2 is an exemplary diagram showing the side view of an inclinable Pilates apparatus support structure.

FIG. 2 is an exemplary diagram showing the side view of an inclinable Pilates apparatus support structure 200. In FIG. 2, a lifting cradle 201 with a length dimension along its longitudinal axis substantially equivalent to the length of the support structure of a Pilates apparatus is shown. In use, a traditional Pilates apparatus would be affixed upon the lifting cradle extending substantially the distance between a pivoting means 204 at one end, and the lifting mechanism 203 at the second end.

One substantially longitudinal portion of the base support structure 205 comprises one or more members that remain on the floor, and that tie the pivoting means 204 to one pivoting point 206 at the second end. The lifting mechanism 203 is actuated by an actuator 202.

Although the structure just described will raise one end of a Pilates apparatus affixed thereupon, it should be noted that any support structure comprising a substantially stationary structure resting horizontally upon a floor, and an inclinable structure pivotally affixed there to which supports a Pilates apparatus (or other exercise machine), and which provides for a means to raise at least one end of the structure distal to the pivoting means may be used.

Figure 3:
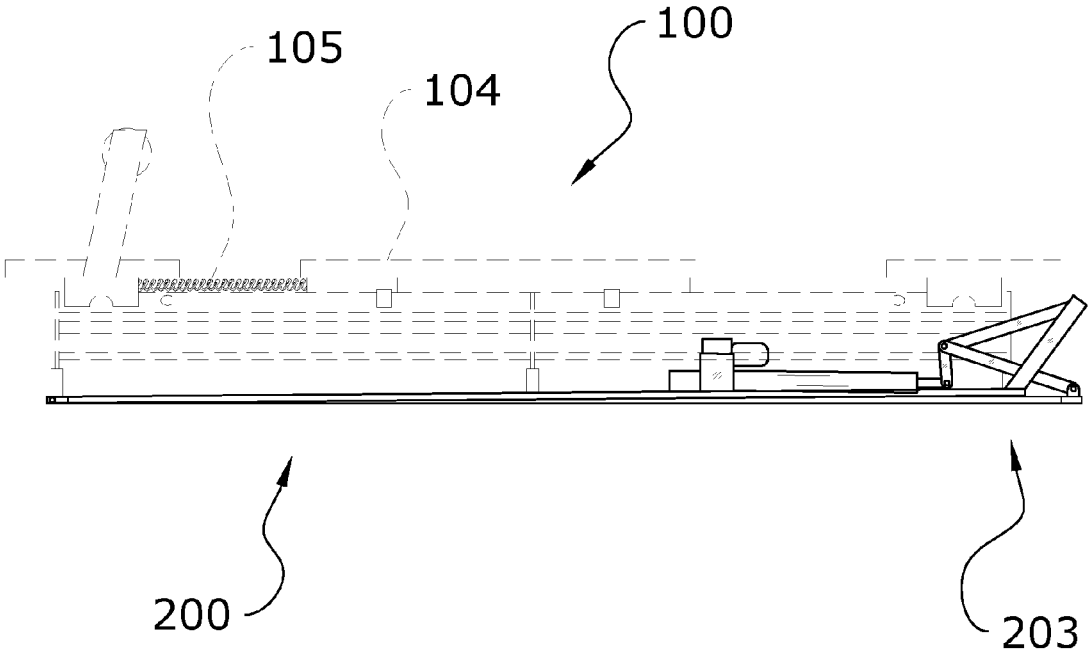
FIG. 3 is an exemplary diagram showing the side view of an inclinable Pilates apparatus support structure with a traditional Pilates apparatuses supported thereupon.

FIG. 3 is an exemplary diagram showing the side view of an inclinable Pilates apparatus support structure with a traditional Pilates apparatuses supported thereupon. More specifically, a representative Pilates apparatus 100 is shown using dotted lines so as not to obscure the inclinable structure of the exercise machine inclination device, but nevertheless, illustrates an approximate placement of a Pilates apparatus upon the inclinable structure 200.

As can readily be seen, the spring biasing means 105 of the Pilates apparatus is shown at one end of the assembled apparatus and inclining structure, and the lifting mechanism 203 of the inclinable structure is shown at the opposite end of the Pilates apparatus.

In practice and in use, when the lifting mechanism is actuated, thereby causing the lifted end of the inclinable structure to increase the vertical dimension between the Pilates apparatus and the floor, a portion of the actual weight of the slidable carriage 104 is added to the total resistance created by the spring biasing means, thereby increasing the required force to overcome the preset resistance level plus the portional weight of the slidable carriage.

Further, when an exerciser not shown is positioned upon the slidable carriage, an additional weight factor is added to the preset resistance level of the spring biasing means, the weight factor determined by well-known mathematical formulae used to determine the force required to push the exerciser's actual weight up a plane inclined at various angles to the horizontal.

Those skilled in the art will appreciate that other factors such as friction between the slidable carriage and the support rails may contribute additional resistance to the total exercise resistance level.

Figure 4:
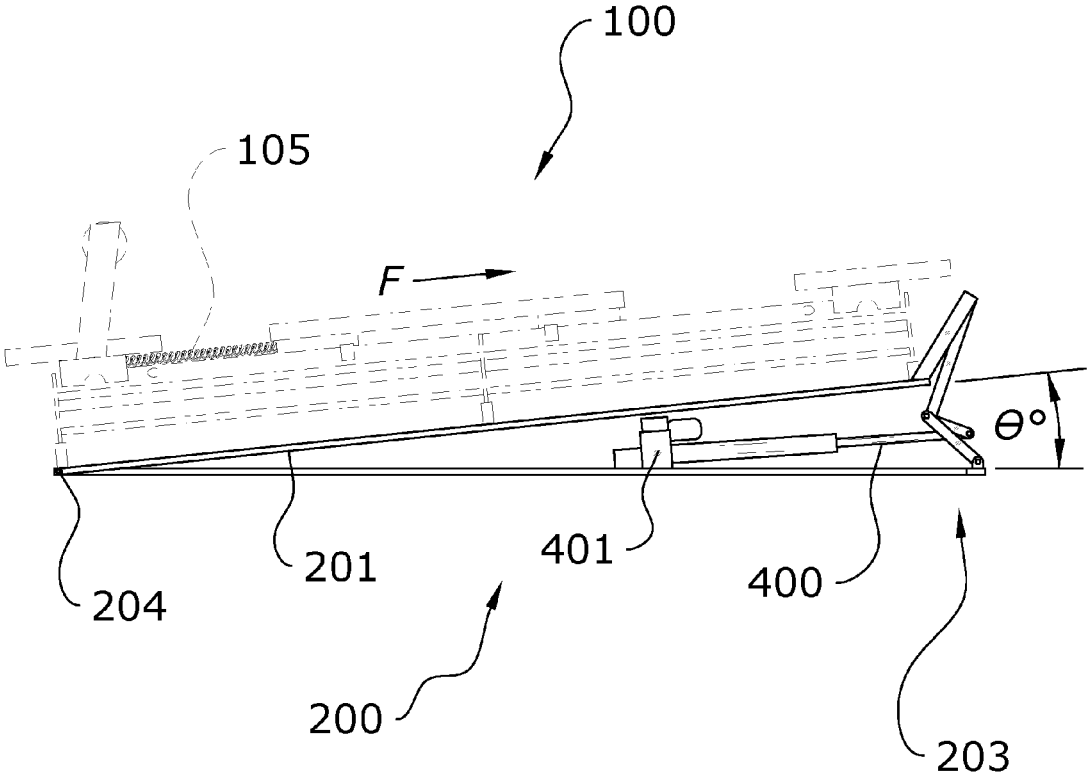
FIG. 4 is an exemplary diagram showing the side view of an inclined Pilates apparatus support structure with a traditional Pilates apparatuses supported thereupon.

FIG. 4 is an exemplary diagram showing the side view of an inclined Pilates apparatus support structure 200 with a traditional Pilates apparatus 100 supported thereupon. Dotted lines are used to illustrate the positioning of the Pilates apparatus 100 so as not to obscure the inclinable structure, but nevertheless, illustrates an approximate placement of a Pilates apparatus upon the inclined structure 200.

As can be readily seen, as the actuator 401 is actuated, a piston ram 400 extending between the actuator and the lifting mechanism 203 is extended, thereby causing a scissors action to occur in the lifting mechanism. As the scissors action occurs, it inclines the lifting cradle 201 of the inclinable structure, and further inclines the Pilates apparatus affixed thereupon, about the pivoting means 204 at the distal end of the inclinable support structure. As can be appreciated, the angle of incline indicated by the theta symbol $\theta$ is variable, and a function of the range of motion of the lifting mechanism.

It should be noted that a large body of art teaches many methods of inclining a plane above the horizontal, including wedges and many variations of jacks, however the speed at which these many means employ if used to elevate one end of a Pilates apparatus is slow, and would not provide the rapid change required to achieve appreciable increase or decrease in exercise intensity within the cycle time of exercise repetitions typically performed on a Pilates apparatus.

Therefore, one improvement over known jacking means is a geometry that is low profile so as not to interfere with the Pilates apparatus, or raise the entire apparatus an unacceptable distance above the floor, and more importantly to provide for very rapid changes in the angle of incline responsive to the slower actual speed of operation of the actuator.

The drawing further illustrates that actual increase in exercise resistance, and therefore the total exercise force F required to overcome the change in total resistance, can be generally determined by the formula: Intensity Increase= [(preset spring 105 resistance level)+(the contributed portion of the weight of the exerciser at a given incline angle)+(the contributed portion of the weight of the slidable carriage at a given incline angle)+(friction)], all of which is created by inclining the Pilates apparatus at an angle of incline above the horizontal plane.

Therefore, with the foregoing description, skilled artisans will immediately appreciate that the novel inclinable support structure provides for variable increase in exercise intensity as one end of a traditionally horizontal Pilates apparatus is raised during exercise, and that the increase in exercise intensity is achieved without interrupting the exercise routine, and further is achieved without changing the preset resistance setting by adding or subtracting spring biasing means between the slidable carriage and stationary end of the Pilates structure.

Figure 5:
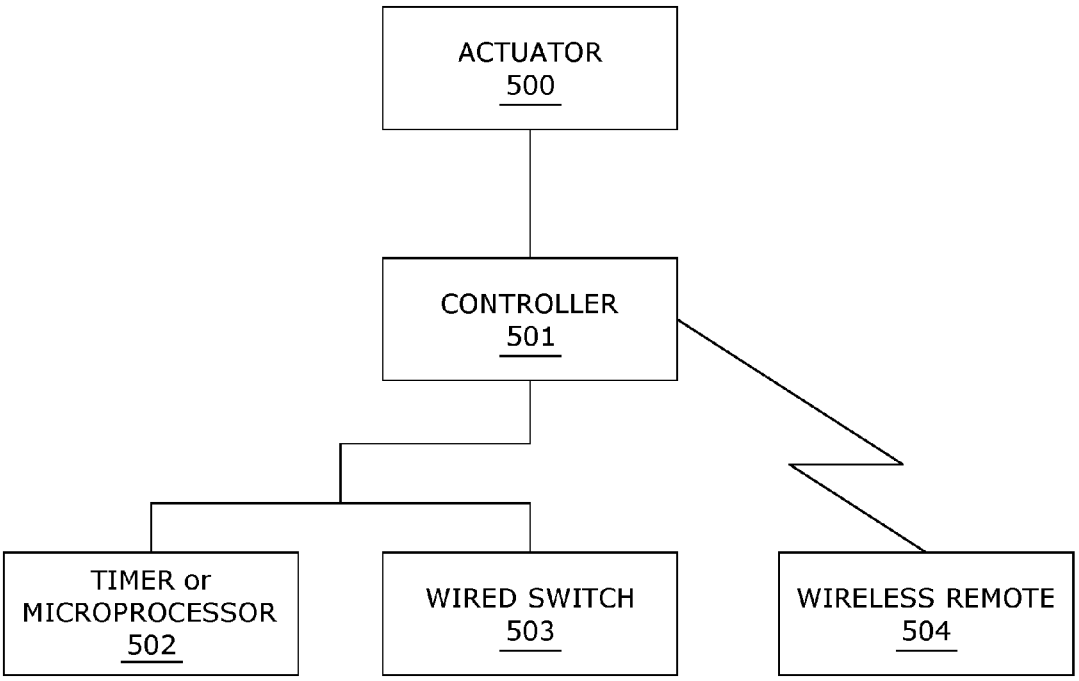
FIG. 5 is an exemplary diagram showing a block diagram of an inclination controller.

FIG. 5 is an exemplary diagram showing a block diagram of an inclination control system. As previously described, it is an important component of interval training to provide for rapid changes in workout intensity, specifically alternating between higher and lower intensity exercise for short periods of time, without stopping or otherwise interrupting the rhythm of the exercise routine. While this cannot be accomplished on traditional Pilates apparatuses, with the exercise machine inclining device, it is possible for the first time. In order for the exerciser to not interrupt their exercise routine, the novel device requires a means of actuating the mechanism to quickly increase or decrease the angle of inclination during the exercise.

Merely as an illustrative example of various means to actuate the mechanism, the diagram shows a powered actuator 500 used to raise or lower the incline angle. An actuator may be a common screw jack, a hydraulic or pneumatic cylinder and piston, or a variety of other powered mechanisms capable of increasing or decreasing length.

A controller 501 is used to send the actuation signal to the actuator, the signal generally being one to increase the length of the actuator, or to decrease it. Through the lifting mechanism linkage, the increased or decreased length translates to increased or decreased height of the lifted end of the inclinable structure. The field of controllers is broad and well known to those skilled in the art. It is therefore not the intention to limit the type or operation of the controller used to signal the actuator, but merely to acknowledge a control means.

The controller is responsive to a signal sent from a sending device. My example, the sending device may be an analog or digital timer or microprocessor 502, the signal being sent to the controller at a prescribed time. Use of a microprocessor allows for a plurality of signals to be preprogrammed, thereby raising or lowering the inclined end of the Pilates apparatus in response to a designated workout routine. As can be readily appreciated, the means to automatically send a signal to the controller as just described provide for the exerciser to continue exercising without interruption, even as the actuator is increasing or decreasing the angle of incline. Correspondingly, the exerciser realized the increase or decrease in exercise intensity as would be desired for accelerating cardiovascular fitness or strength training.

In some instances, it may be preferred to signal the controlled at non-programmed times, for instance, when the exerciser or trainer does not know all of the exercises that will be performed during a given routine. In such instances, a means to change the inclination angle on demand, and further to change the degree of angular change is provided by a wired switch 503. As one of the simplest forms of controlling a powered actuator, the wired switch may be conveniently located near the hand of the exerciser, or may be operated by the trainer without requiring engagement by the exerciser.

Yet another example of a signal sending means is shown as a wireless remote 504, the remote being one of a number of well-known devices capable of sending a signal via Bluetooth or WIFI to a receiver in communication with the controller. Such devices may include, but are not limited to a paired smartphone with a controller application installed, the smartphone being conveniently worn by the exerciser, a WIFI enabled computer in communication with one or more actuators within a gym facility or Pilates studio whereby the computer signal would communicate appropriate instructions to one or more controllers within the facility.

It is not the intention of the exercise machine inclination device to limit the types of control signal sending devices or types of controllers, but any wired or wireless means may be used, so long as such devices and controllers provide for changing the position of an actuator, and correspondingly the lifting mechanism to increase or decrease the exercise intensity during the performance of an exercise routine on a Pilates apparatus.

Figure 6:
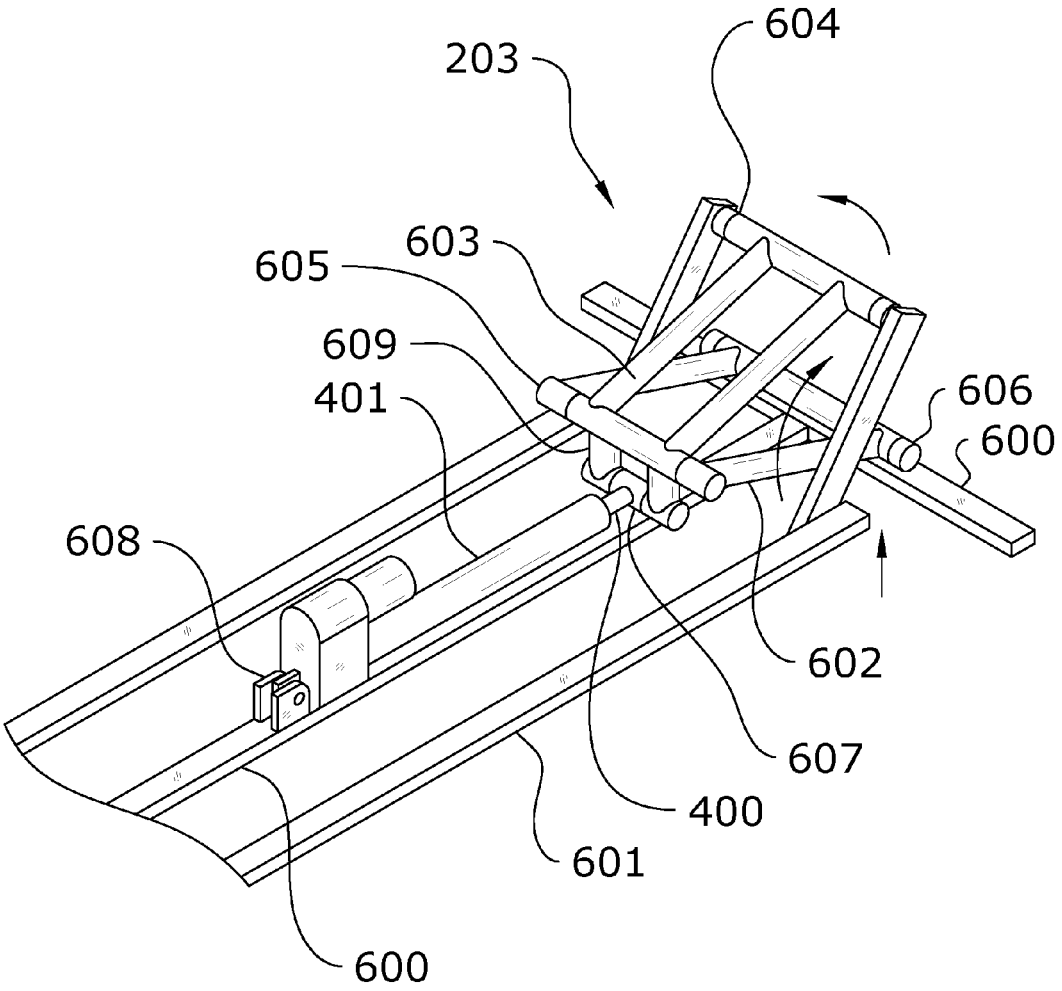
FIG. 6 is an exemplary diagram showing an orthographic view of the lifting end of the lifting structure.

FIG. 6 is an exemplary diagram showing an orthographic view of the lifting end of the lifting structure. It should be noted that although the body of art related to scissors jacks and screw jacks is extensive, the mechanical advantage of traditional jacks is biased toward a high lifting force ratio which typically corresponds to a low movement response ratio relative to input force and force distance. In one embodiment, the exercise machine inclination device provides for a high movement response ratio as is necessary for rapid change in elevation, and therefore incline.

A stable structure 600 serves as the platform from which all inclination movement originates, the structure comprising wide-stance feet positioned substantially at opposite ends of the substantially longitudinal structure to provide lateral stability. A lifting cradle 601 provides a load-support surface upon which a traditional Pilates apparatus is affixed. As the lift mechanism 203 is actuated, it raises or lowers the lift cradle.

A actuator 401 is affixed to the stationary support structure 600 by means of a clevis bracket 608 and pivotable thereabout. The actuator 401 may be a pneumatic or hydraulic cylinder that extends or retracts a ram 400 in response to a controller not shown. Upon actuation, a force is applied to a load bushing 607 that transfers the force through a trunnion to a pair of actuating lever arms 609.

The applied force is transferred from the lever arms about the fulcrum 605 to a pair of longer upper lift arms 603. The force creates a high movement ratio compared to the movement of the ram. The reactive force is transmitted through a pivotable trunnion 604 that causes an immediate elevation change to the lifted end of the lift cradle 601.

As the ram 400 continues to extend, one angular reactive force is provided by a pair of lower lift arms 602 pivotally attaches to the support structure 600. The continues ram extension therefore causes the angle between the upper and lower lift arms to increase about the elbow joint 605, the elbow joint also being the fulcrum between the actuating lever arms and upper lift arms. The "scissors" action between the upper and lower lift arms provide for smooth continued elevation changes in response to ram movement.

Therefore, as just described, the lifting mechanism of the exercise machine inclination device provides for a high lift to ram movement ratio to rapidly increase or decrease inclination, and therefore exercise intensity, while also providing exceptional lateral stability of the lift cradle and the traditional Pilates apparatus affixed thereupon. As can be further appreciated, the very low profile of the support structure and lift cradle provides for a minimum height increase of the traditional Pilates apparatus when compared to the apparatus when placed on a floor. One of the various novel functions of the exercise machine inclination device provides for rapid variation of exercise intensity when exercises are performed on traditional Pilates apparatuses, and further provides for intensity variation without stopping or otherwise interrupting the exerciser's routine. Therefore, the exercise machine inclination device provides a commercially valuable function previously unavailable on Pilates apparatuses or other exercise machines.

Figure 7:
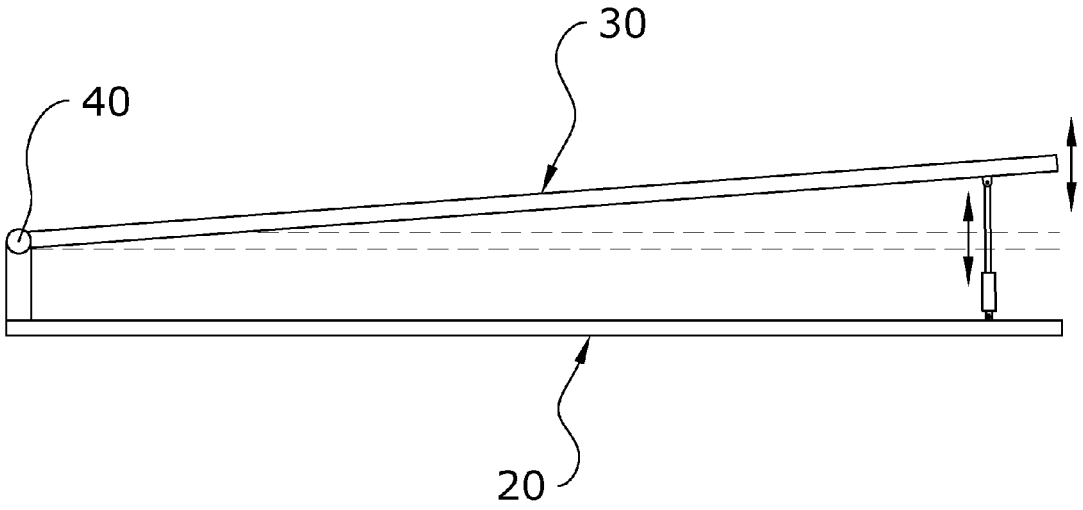
FIG. 7 is a side view of an exercise machine inclination device in accordance with an example embodiment.
Figure 8:
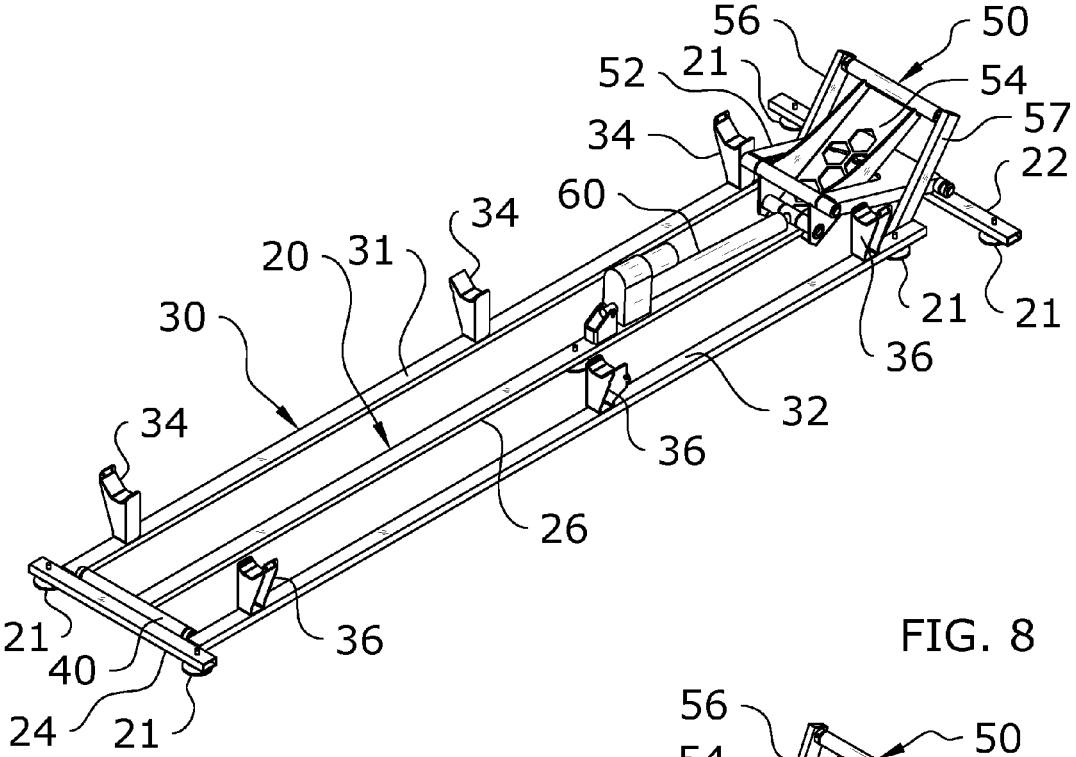
FIG. 8 is an upper perspective view of an exercise machine inclination device in a lowered position in accordance with an example embodiment.
Figure 9:
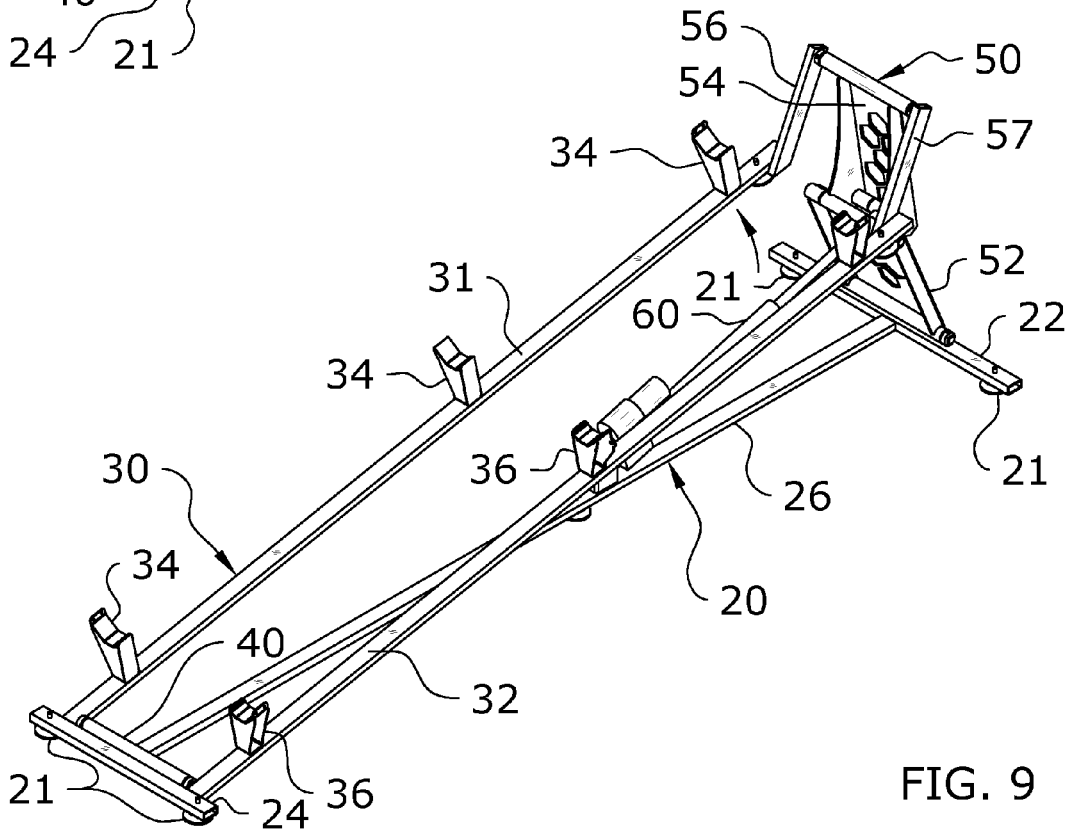
FIG. 9 is an upper perspective view of an exercise machine inclination device in a raised position.

FIGS. 1 through 18 illustrate various embodiments of an inclination device for lifting and lowering at least one end of an exercise machine 12. FIGS. 1 through 4 and 6 illustrate embodiments wherein the legs 16 of the exercise machine 12 (e.g. a Pilates machine) are connected to the support structure 30 such as, but not limited to, positioning the legs 16 upon an upper surface of the support structure 30. FIG. 7 illustrates an embodiment that utilizes an actuator directly connected between the base 20 and the support structure 30. FIGS. 8 through 18 illustrate an embodiment that utilizes an actuator indirectly connected between the base 20 and the support structure 30. In the various embodiments, the exercise machine 12 may be attached with fasteners 38 (e.g. bolts), straps or other retaining devices. Alternatively, the exercise may not be directly attached with fasteners 38 or other retaining devices.

The various embodiments of the present invention may be attached (or otherwise connected) to an exercise machine 12 (e.g. Pilates machine) as an aftermarket product by the consumer, attached to the exercise machine 12 prior to selling to the consumer, attached to the exercise machine 12 at the factory, integrally assembled with the exercise machine 12 or attached to the exercise device at any other time that is desired. In other words, it is not significant as to the timing of when the various embodiments of the present invention are attached or otherwise connected to the exercise machine 12. For example, the various embodiments of the present invention may be attached to an existing exercise machine 12 that is not capable of elevating as an aftermarket product. As another example, the various embodiments of the present invention may be attached to a new exercise machine 12. Various other configurations and attachments may be used to connect the various embodiments of the present invention to an exercise machine 12 such as, but not limited to, a Pilates machine. As another example, the various embodiments of the present invention may be used with exercise machine 12s that are not Pilates machines such as, but not limited to, treadmills, elliptical machines, weight lifting machines, rowing machines, exercise bikes and the like.

The exercise machine 12 has a first end and a second end. The exercise machine 12 preferably is comprised of a Pilates machine comprised of an elongated frame having a first end and a second end, at least one rail 14 connected to the frame and a carriage 18 movably positioned upon the rail 14 with tension devices (e.g. springs, elastic bands) connected between the carriage 18 and the frame to provide resistance to the exerciser, wherein the carriage 18 is adapted to be movable along an axis extending between a first end and a second end of the rail 14. U.S. Pat. No. 7,803,095 to Lagree and U.S. Pat. No. 8,641,585 to Lagree both illustrate Pilates machines suitable for use with respect to the various embodiments of the present invention and is incorporated by reference herein.

The base 20 has a first end and a second end opposite of the first end. The base 20 is adapted for being positioned upon a floor in a horizontal manner as illustrated in FIGS. 7 and 10 through 12. The base 20 is preferably a generally flat and low profile structure so as to not interfere with the operation of the exercise machine 12. The base 20 and/or support structure 30 may include a plurality of pads 21 extending from the bottom surface of the base 20 to provide gripping to the surface of the floor and to prevent damage to the surface of the floor. The base 20 may be movably positioned upon the floor or non-movably attached to the floor. Though not shown in the figures, the base 20 may be comprised of the floor itself wherein the actuator is connected between the floor (i.e. base 20) and the support structure 30.

Figure 13:
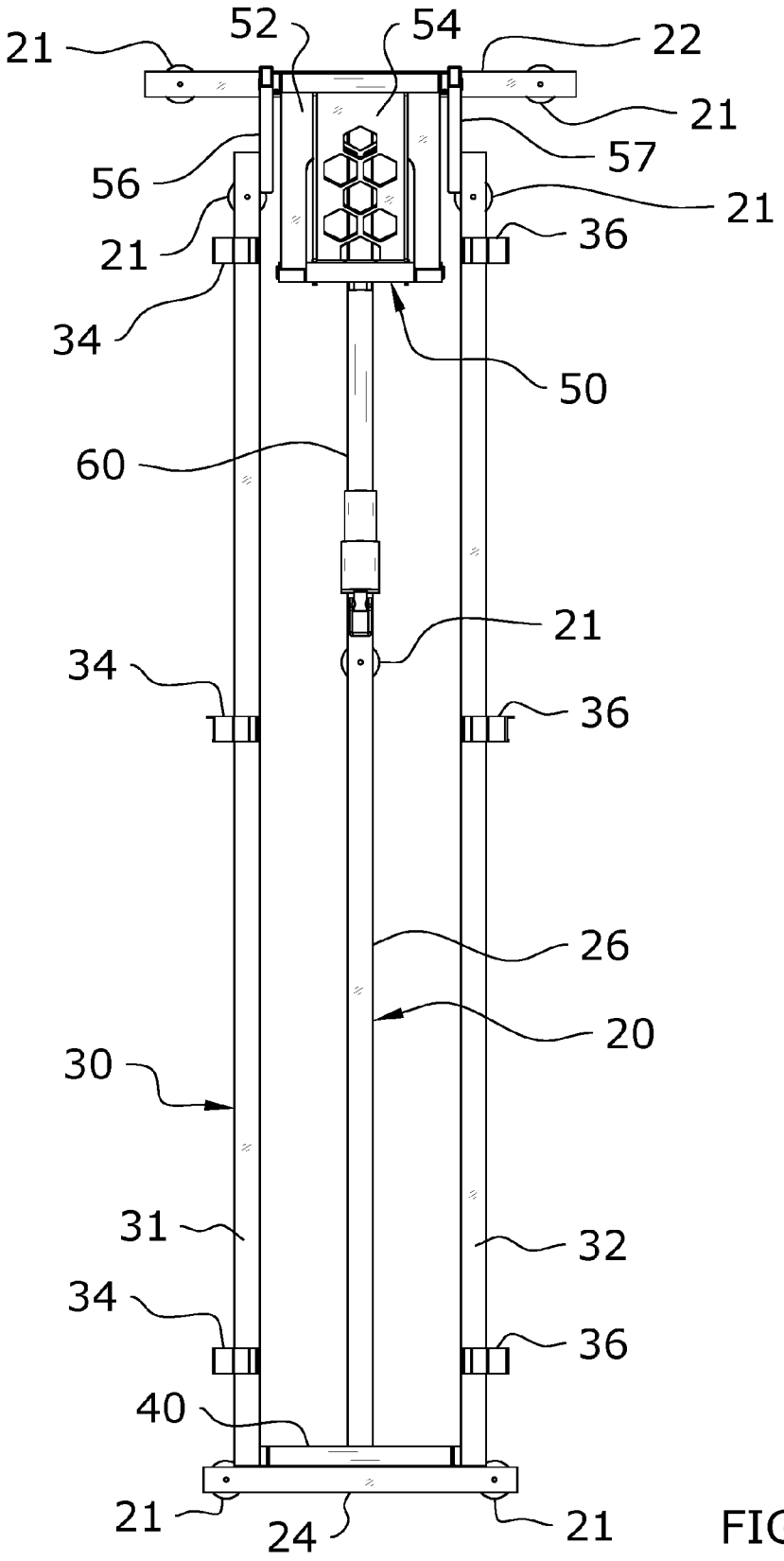
FIG. 13 is a top view of an exercise machine inclination device in accordance with an example embodiment.
Figure 14:
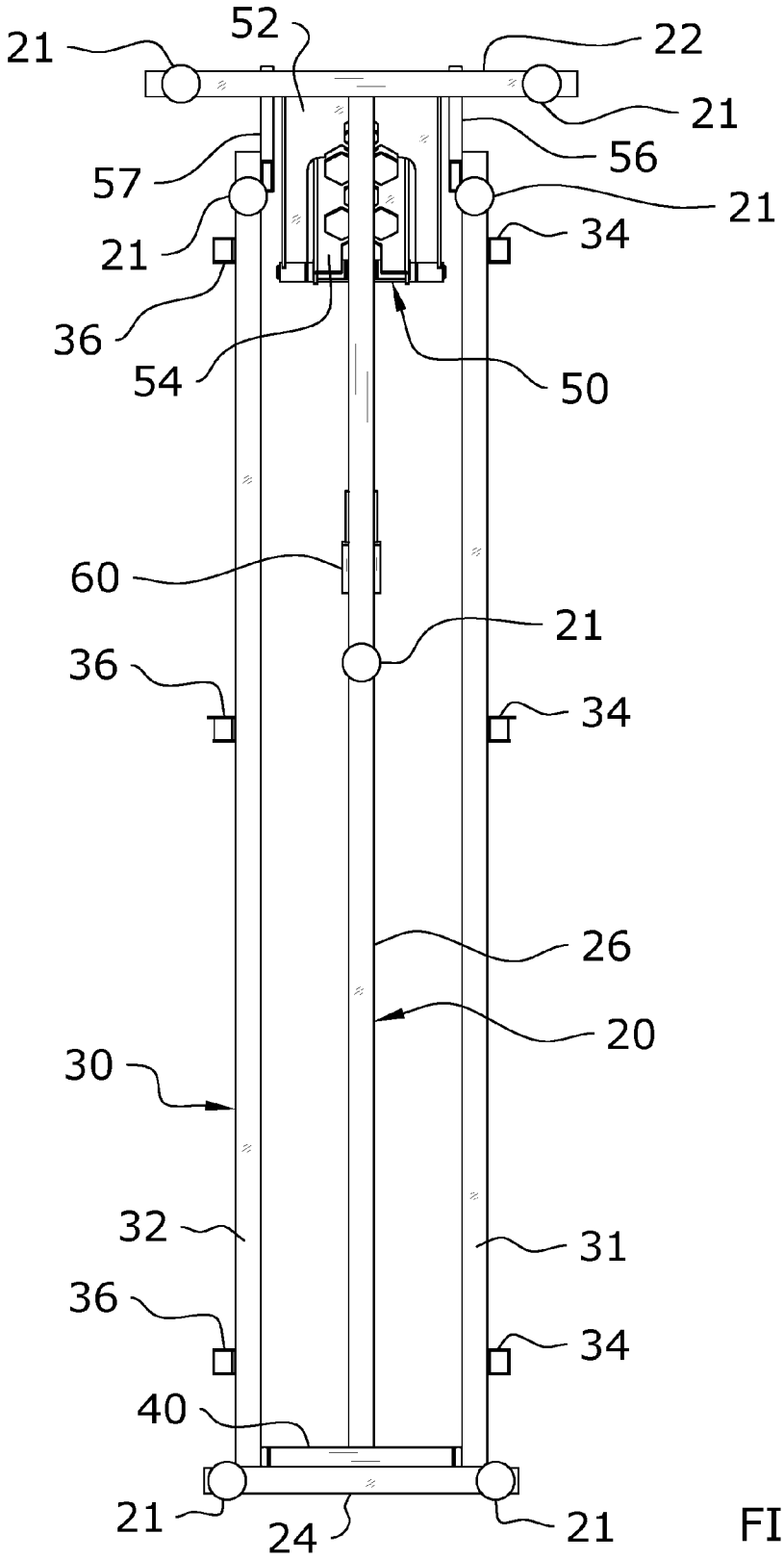
FIG. 14 is a bottom view of an exercise machine inclination device in accordance with an example embodiment.
Figure 15:
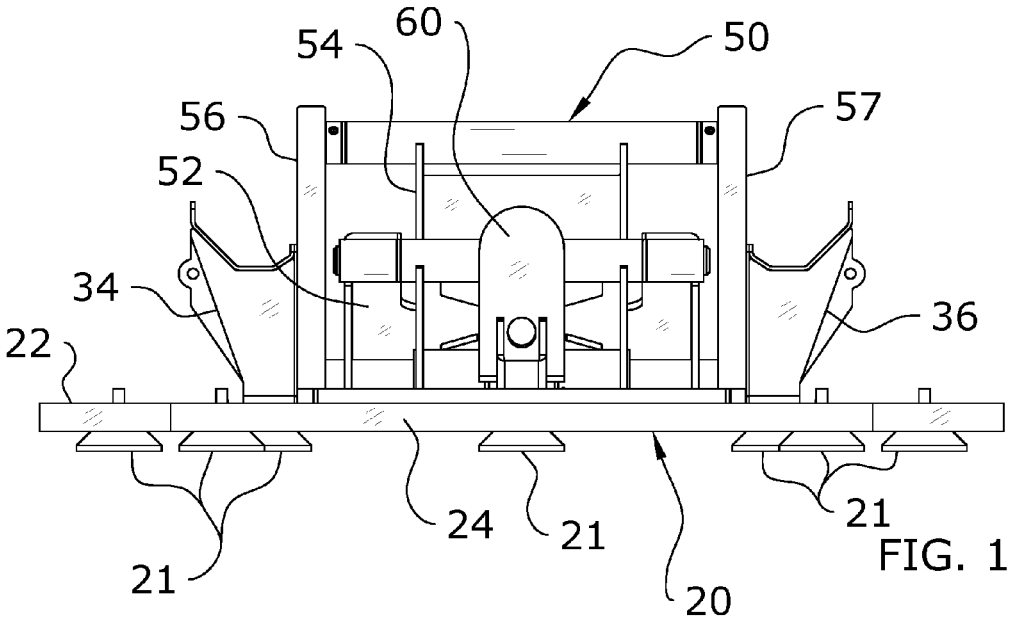
FIG. 15 is a first end view of an exercise machine inclination device in accordance with an example embodiment.
Figure 16:
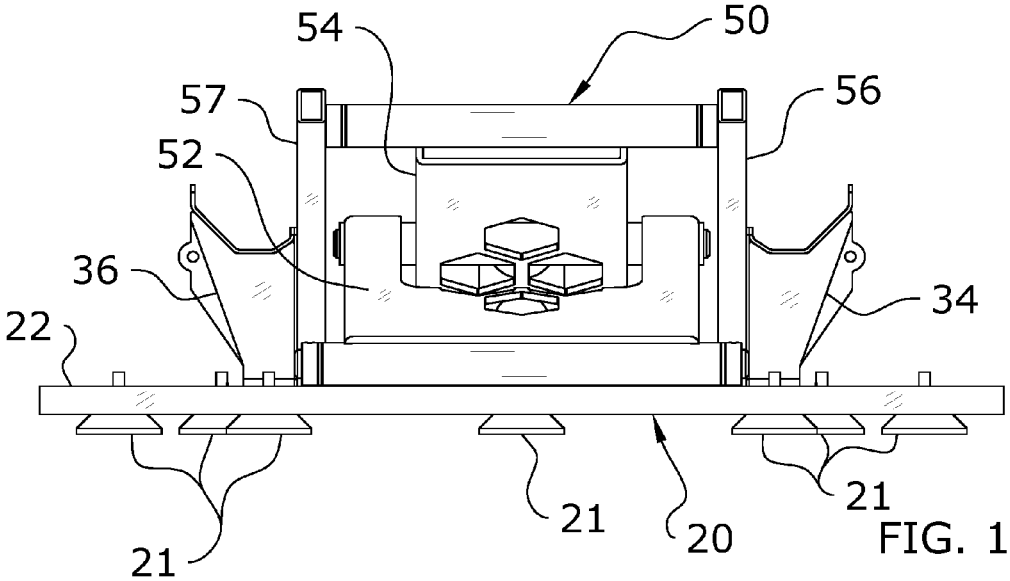
FIG. 16 is a second end view of an exercise machine inclination device in accordance with an example embodiment.
Figure 17:
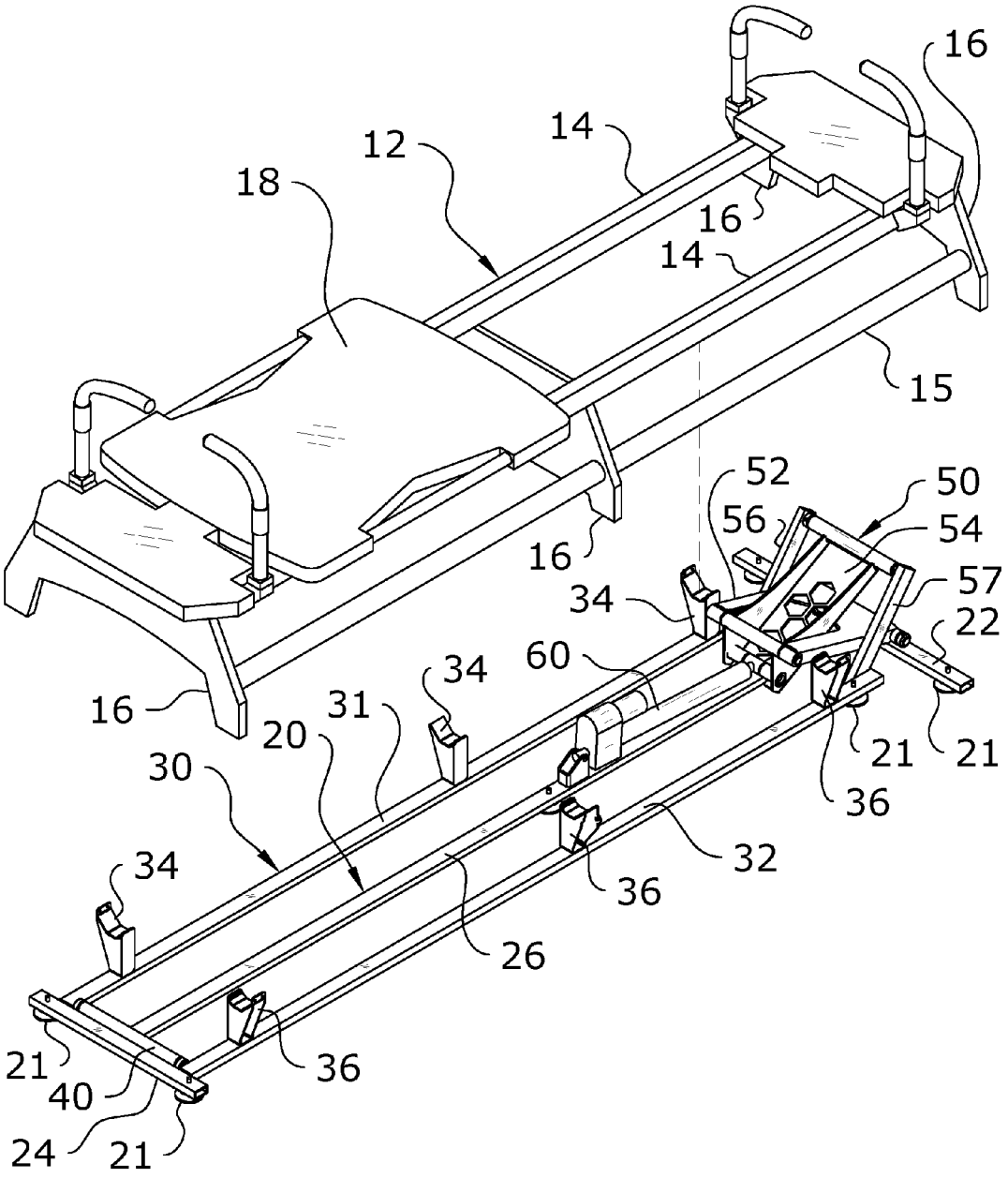
FIG. 17 is an exploded perspective view of an exercise machine inclination device with respect to an exercise machine in accordance with an example embodiment.

The base 20 has a length approximately the same as the exercise machine 12 to be used with respect to the inclination device. The base 20 is preferably an elongated structure having a longitudinal axis parallel to the longitudinal axis of the exercise machine 12 being supported as illustrated in FIGS. 13 and 14. The base 20 may be comprised of various structures such as a flat sheet. The base 20 may also be comprised of a non-sheet structure wherein an elongated connecting member 26 is connected between a first end member 24 and a second end member 22 forming an I-shaped structure as best illustrated in FIGS. 13 and 14 of the drawings. The base 20 is preferably comprised of a rigid material such as, but not limited to, metal.

A hinge 40 pivotally connects the base 20 and the support structure 30 together. The hinge 40 is preferably positioned near the first end of the base 20 and the first end of the support structure 30, however, the hinge 40 may be positioned near the second end of the base 20 or anywhere between the first end and second end of the base 20. The hinge 40 is preferably attached to an inner surface of the base 20 near or adjacent to the floor to assist in maintaining a low profile for the combination of the base 20 and the support structure 30 when in the lowered position.

The support structure 30 has a first end and a second end opposite of the first end. The support structure 30 has an elongated structure that extends along a substantial portion of the length of the exercise machine 12. The support structure 30 may have a length near or longer than the length of the exercise machine 12.

The support structure 30 is adapted for supporting an exercise machine 12 (e.g. a Pilates machine). Various types of exercise machines 12 (e.g. sizes, brands, types, lengths) may be positioned upon the support structure 30. The support structure 30 may be suitable for being used upon one or more brands of Pilates machines for example. The exercise machine 12 is positioned upon and vertically supported by the support structure 30 as illustrated in FIGS. 1, 3, 4 and 18. The support structure 30 is a rigid structure capable of lifting the weight of the exercise machine 12 along with the exerciser without noticeable movement so as to not to interfere with the operation of the exercise machine 12 by the exerciser.

Figure 10:
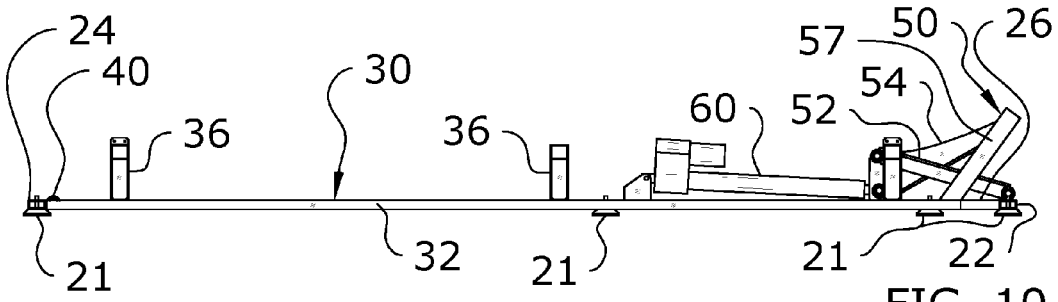
FIG. 10 is a side view of an exercise machine inclination device in a lowered position.

The support structure 30 may be comprised of various structures suitable for supporting, lifting and lowering an exercise machine 12. For example, the support structure 30 may be comprised of a rigid sheet of metal that the exercise machine 12 is positioned upon the upper surface thereof. FIGS. 1 through 4 and 5 through 18 illustrate various embodiments of the support structure 30. While the support structure 30 is illustrated as being elongated and relatively flat in structure, the support structure 30 may be a non-elongated and non-flat structure (e.g. a simple bracket attached directly to the actuator of the lift assembly 50). While not required, the support structure 30 is preferably substantially parallel with respect to the base 20 when in the lowered position as illustrated in FIGS. 2, 3, and 10 of the drawings.

In one embodiment, the support structure 30 may be comprised of a first support member 31 and a second support member 32 each having an elongated structure. The first support member 31 and the second support member 32 preferably are parallel to one another and are distally spaced apart from one another a distance that corresponds to the distance between the left and right side legs 16 of the exercise machine 12. The left legs 16 of the exercise machine 12 are positioned upon the first support member 31 and the right legs 16 of the exercise machine 12 are positioned upon the second support member 32 to support the exercise machine 12 in a movable manner by the support structure 30 moving. As the support structure 30 moves, the exercise machine 12 moves correspondingly and simultaneously without movement between the support structure 30 and the exercise machine 12. The legs 16 of the exercise machine 12 may be secured with fasteners 38 (or other restraining devices such as straps) to the support members 31, 32 of the support structure 30 or unsecured. It is preferable that the legs 16 are attached to the support structure 30 with fasteners 38 or other restraining device to prevent movement of the exercise machine 12 with respect to the support structure 30 during usage.

Figure 18:
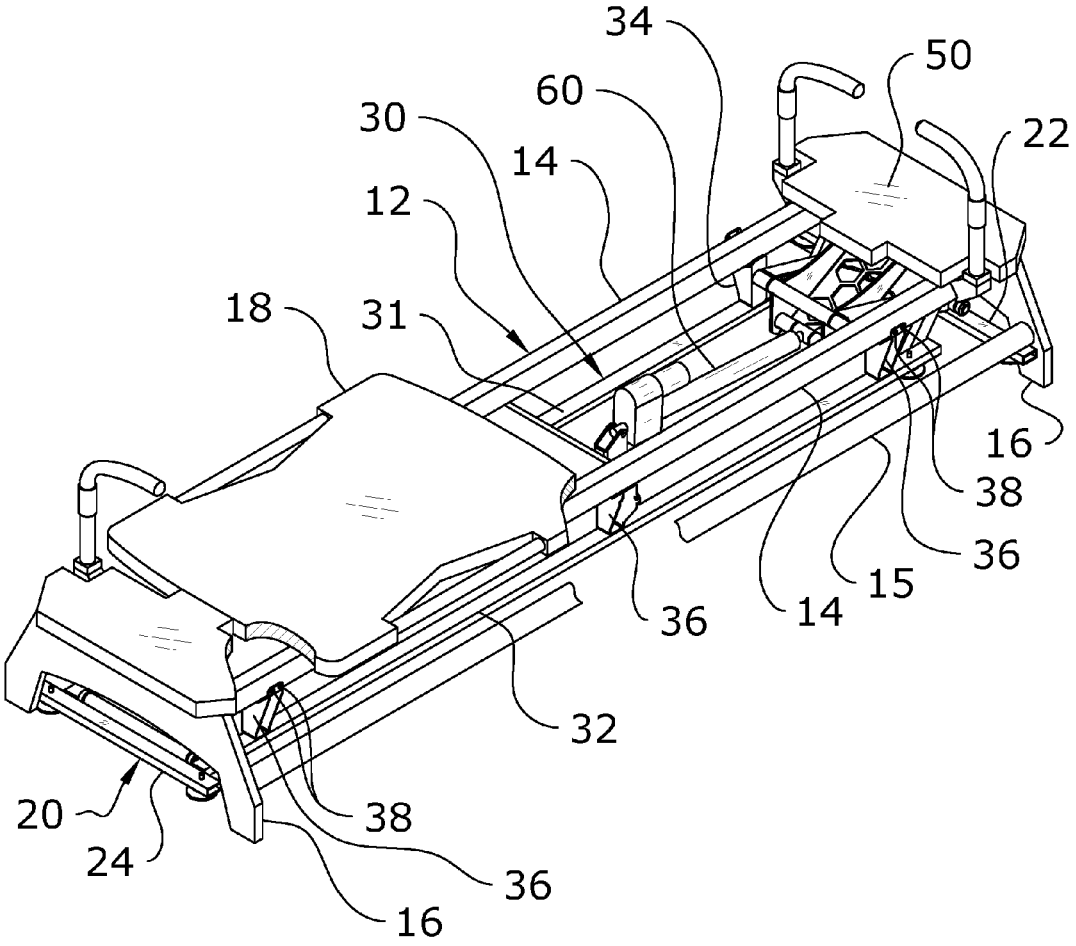
FIG. 18 is a perspective view of an exercise machine attached to an exercise machine inclination device in accordance with an example embodiment

In another embodiment, the support structure 30 includes one or more brackets 34, 36 extending from the support structure 30 that are connected to the exercise machine 12. The brackets 34, 36 may have various configurations suitable for connecting to the exercise machine 12. The brackets 34, 36 preferably are adapted for connecting to the exercise machine 12 in a non-movable manner. For example, one or more brackets may extend from the support structure 30 to be connected to the exercise machine 12 at a desired location such as, but not limited to, the frame, brace members 15 or rails 14 of the exercise machine 12. The brackets 34, 36 preferably extend upwardly from the support structure 30 but may extend horizontally or any angle between thereof. The brackets 34, 36 may have an upper channel that receives a portion of the exercise machine 12 such as the frame, the rails 14 or brace members 15. FIG. 18 illustrates an embodiment wherein the upper channels within the brackets 34, 36 extend parallel to the longitudinal axis of the rails 14 and receive the respective rails 14 (i.e. the first brackets 34 receive and support the first rail 14 and the second brackets 36 receive and support the second rail 14). One or more of the brackets 34, 36 may have one or more threaded apertures within that threadably receive fasteners 38 to secure the exercise machine 12 to the brackets as illustrated in FIG. 18. Alternatively, the apertures may not be threaded and simply allow the fasteners 38 to extend through the aperture to engage the frame or rails 14 of the exercise machine 12. The fasteners 38 may be comprised of screws, bolts, non-threaded pins and the like.

In another embodiment, one or more first brackets 34 extend upwardly from near a first side of the support structure 30 and one or more second brackets 36 extend upwardly from near a second side of the support structure 30. The first brackets 34 are adapted to connect to a first side of the exercise machine 12 and the second brackets 36 are adapted to connect to a second side of the exercise machine 12. For example, the first brackets 34 may be connected to the first rail 14 and the second brackets 36 may be connected to the second rail 14 of the exercise machine 12. The first brackets 34 and second brackets 36 may be attached to various structures.

In another embodiment, one or more first brackets 34 extend from the first support member 31 and one or more second brackets 36 extend from the second support member 32 as best illustrated in FIGS. 8, 9, 13 and 17 of the drawings. The first support member 31 and the second support member 32 are elongated rigid structures capable of supporting the weight of the exercise machine 12 and an exerciser performing an exercise. The first brackets 34 and the second brackets 36 are preferably distally spaced apart a distance and are preferably aligned with one another as illustrated in FIG. 13 of the drawings.

One or more actuators are connected (directly or indirectly) between the base 20 and the support structure 30. The actuator adjusts an angle of the support structure 30 so that one end of the support structure 30 and the corresponding end of the exercise machine 12 are elevated above the opposing end. The actuator moves in a first direction to cause the support structure 30 to elevate at one end and moves in a second direction to cause the support structure 30 to lower at the same end. The actuator may be comprised a hydraulic actuator, electric actuator, pneumatic actuator or mechanical actuator. The actuator is preferably provides motorized power using a motor (e.g. electric motor, hydraulic motor, pneumatic motor). The actuator may also be comprised of a linear actuator that extends and retracts in a linear manner (e.g. mechanical linear actuators, hydraulic linear actuators, pneumatic linear actuators, electro-mechanical actuators, telescoping linear actuator). The actuator may also be comprised of non-linear actuators such as, but not limited to, rotary actuators that produce rotary motion or torque (e.g. stepper motor, servomotor). While not required, the actuator is preferably positioned near the second end of the support structure 30 for lifting and lowering the second end of the support structure 30 and correspondingly lifting and lowering the second end of the exercise machine 12. The actuator may be positioned in various locations and a connector (e.g. cable) may be used to perform the lifting and lowering of the support structure 30. The actuator is shown as being attached to a central portion of the connecting member 26 but the actuator may be connected in various other manners.

In another embodiment, a lift assembly 50 is positioned between the actuator and the support structure 30. The lift assembly 50 is connected to the actuator and converts the motion of the actuator (e.g. linear motion or rotary motion) into a lifting or lower motion to lift and lower the second end of the support structure 30 with respect to the first end of the support structure 30. In one embodiment, the lift assembly 50 is comprised of a scissor jack having a lower member 52 pivotally attached to the base 20 and an upper member 54 attached to the support structure 30. It is preferable that the upper member 54 and the lower member 52 are comprised of a rigid and broad structure to provide stability to the support structure 30 during movement of the support structure 30 during an exercise. Various other types of lift assemblies may be used (e.g. screw jack).

In one embodiment, a first arm 56 and a second arm 57 extend downwardly from opposing sides of the upper end of the lift assembly 50 and are respectively connected to the first support member 31 and the second support member 32 near or at the second end thereof to lift/lower the support members 31, 32. The first arm 56 and the second arm 57 are preferably pivotally connected to the lift assembly 50 at their respective upper end and non-movably connected to the support members 31, 21, however, various other configurations may be utilized.

Figure 11:
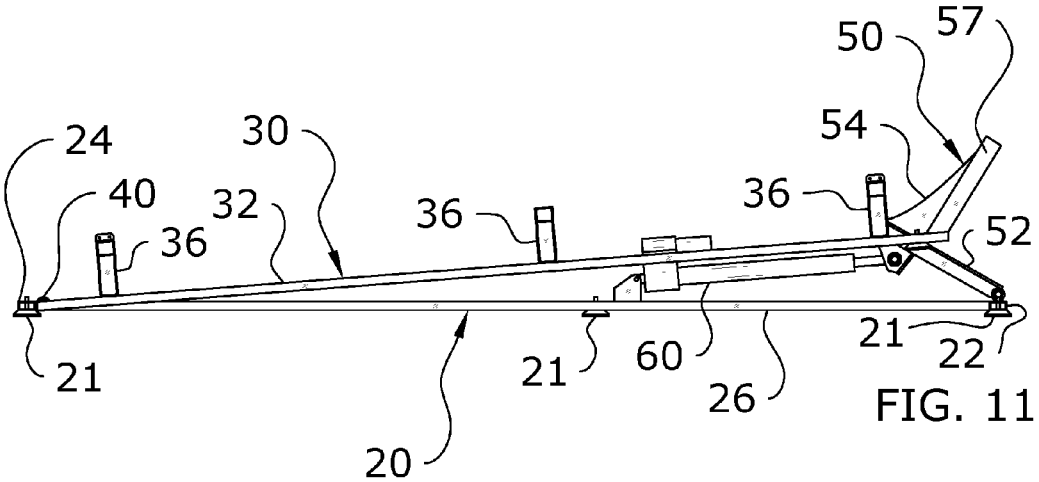
FIG. 11 is a side view of an exercise machine inclination device in an intermediate position between the raised position and the lowered position.
Figure 12:
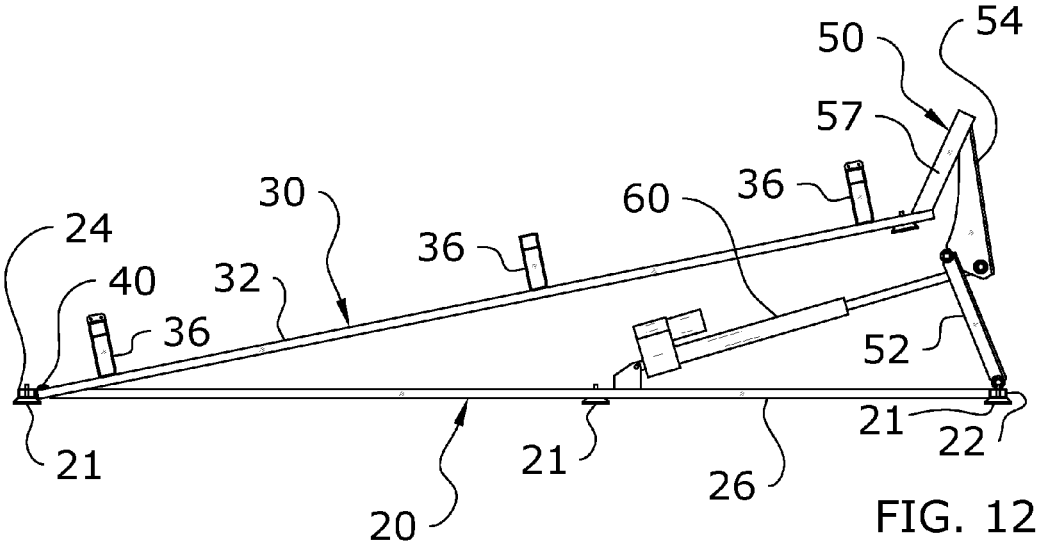
FIG. 12 is a side view of an exercise machine inclination device in a raised position.

In operation of one or more of the various embodiments, the operator will manipulate a control unit (e.g. select an "Up" button on the control unit) which activates the actuator to move in a first direction causing the second end of the support structure 30 to lift upwardly with respect to the first end of the support structure 30 which is pivotally connected to the base 20 by the hinge 40 as shown in FIGS. 11 and 12 of the drawings. The support structure 30 pivots with respect to the base 20 via the hinge 40 to various desired angles of movement. Once the desired angle of incline is achieved (either preprogrammed or manually stopped by the user), the actuator is stopped thereby stopping the lifting of the support structure 30. With the support structure 30 at a desired angle of incline from the first end to the second end (e.g. 5 degrees), the exercise machine 12 is also at the same angle of incline. The exerciser thereafter experiences increased resistance when moving the carriage 18 towards the second end of the support structure 30 because of the increased gravitational force applied by the body weight of the exerciser and the increased gravitational force applied to the weight of the carriage 18. Correspondingly, the exerciser experiences a decreased resistance when moving the carriage 18 toward the opposite first end of the support structure 30. The exerciser (or instructor) may change the angle of incline again to increase the resistance force by increasing the angle or decrease the resistance by decreasing the angle. The exerciser may also adjust the resistance force by adding or removing tension devices (e.g. springs) connected to the carriage 18. When the exerciser is finished exercising, the exerciser may select a "Lower" or "Home" button on the control unit which then lowers the support structure 30 to a state that is approximately level with or parallel with respect to the base 20 as shown in FIG. 10 of the drawings. When the support structure 30 is parallel with the base 20, the support structure 30 is also parallel with respect to the floor and the exercise machine 12 is also parallel with respect to the floor. The second end of the support structure 30 is preferably in engagement with the floor when fully lowered either directly or indirectly (e.g. via pads extending downwardly that engage the floor when fully lowered). When the support structure 30 and the exercise machine 12 is parallel with respect to the floor, there is no incline of the exercise machine 12 or increased resistance force applied to the carriage 18 other than the normal tension devices connected to the carriage 18.

Unless otherwise defined, all technical and scientific terms used herein have the same meaning as commonly understood by one of ordinary skill in the art to which this invention belongs. Although methods and materials similar to or equivalent to those described herein can be used in the practice or testing of the exercise machine inclination device, suitable methods and materials are described above. All publications, patent applications, patents, and other references mentioned herein are incorporated by reference in their entirety to the extent allowed by applicable law and regulations. The exercise machine inclination device may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

What is claimed is:

1. An inclination device for lifting and lowering at least one end of an exercise machine, comprising:

a base having a first end and a second end opposite of the first end, wherein the base is adapted for being positioned upon a floor;

a support structure having a first end and a second end opposite of the first end, wherein the support structure is adapted for supporting and removably attaching to an exercise machine, wherein the exercise machine can be removably attached to the support structure;

a hinge pivotally connecting the base and the support structure; and an actuator connected between the base and the support structure, wherein the actuator adjusts an angle of the support structure.

2. The inclination device of claim 1, wherein the hinge is positioned near the first end of the base and the first end of the support structure.

3. The inclination device of claim 2, wherein the actuator is positioned near the second end of the support structure for lifting and lowering the second end of the support structure.

4. The inclination device of claim 3, including a lift assembly positioned between the actuator and the support structure.

5. The inclination device of claim 4, wherein the lift assembly is comprised of a scissor jack.

6. The inclination device of claim 1, wherein the actuator is comprised of a linear actuator.

7. The inclination device of claim 1, including a bracket extending from the support structure, wherein the bracket is adapted to connect to the exercise machine.

8. The inclination device of claim 1, including a first bracket extending from near a first side of the support structure and a second bracket extending from near a second side of the support structure, wherein the first bracket is adapted to connect to a first side of the exercise machine and wherein the second bracket is adapted to connect to a second side of the exercise machine.

9. The inclination device of claim 1, wherein the support structure is comprised of a first support member and a second support member, wherein the first bracket extends upwardly from the first support member and wherein the second bracket extends upwardly from the second support member.

10. The inclination device of claim 1, including a plurality of first brackets extending upwardly from near a first side of the support structure and a plurality of second brackets extending upwardly from near a second side of the support structure, wherein the first brackets are adapted to connect to a first side of the exercise machine and wherein the second brackets are adapted to connect to a second side of the exercise machine.

11. An inclination device for lifting and lowering at least one end of an exercise machine, comprising:

an exercise machine having a first end and a second end;

a base having a first end and a second end opposite of the first end, wherein the base is adapted for being positioned upon a floor;

a support structure having a first end and a second end opposite of the first end, wherein the support structure is adapted for supporting and removably attaching to an exercise machine and wherein the exercise machine is removably positioned upon the support structure;

a hinge pivotally connecting the base and the support structure; and an actuator connected between the base and the support structure, wherein the actuator adjusts an angle of the support structure.

12. The inclination device of claim 11, wherein the hinge is positioned near the first end of the base and the first end of the support structure.

13. The inclination device of claim 12, wherein the actuator is positioned near the second end of the support structure for lifting and lowering the second end of the support structure.

14. The inclination device of claim 13, including a lift assembly positioned between the actuator and the support structure.

15. The inclination device of claim 14, wherein the lift assembly is comprised of a scissor jack.

16. The inclination device of claim 11, wherein the actuator is comprised of a linear actuator.

17. The inclination device of claim 11, including a bracket extending from the support structure, wherein the bracket is adapted to connect to the exercise machine.

18. The inclination device of claim 11, including a first bracket extending from near a first side of the support structure and a second bracket extending from near a second side of the support structure, wherein the first bracket is adapted to connect to a first side of the exercise machine and wherein the second bracket is adapted to connect to a second side of the exercise machine.

19. The inclination device of claim 11, wherein the support structure is comprised of a first support member and a second support member, wherein the first bracket extends upwardly from the first support member and wherein the second bracket extends upwardly from the second support member.

20. The inclination device of claim 11, wherein the exercise machine is comprised of a frame having a first end and a second end, a rail connected to the frame and a carriage movably positioned upon the rail, wherein the carriage is adapted to be movable along an axis extending between a first end and a second end of the rail.

21. An inclination device for lifting and lowering at least one end of an exercise machine, comprising:

a base having a first end and a second end opposite of the first end, wherein the base is adapted for being positioned upon a floor;

a support structure having a first end and a second end opposite of the first end, wherein the support structure is adapted for supporting and removably attaching to an exercise machine, wherein the exercise machine can be removably attached to the support structure;

wherein the exercise machine is comprised of a frame having a first end and a second end, a rail connected to the frame and a carriage movably positioned upon the rail, wherein the carriage is adapted to be movable along an axis extending between a first end and a second end of the rail;

a hinge movably connecting the base and the support structure, wherein the hinge is positioned near the first end of the base and the first end of the support structure; and an actuator connected between the base and the support structure, wherein the actuator adjusts an angle of the support structure and wherein the actuator is comprised of a linear actuator.

22. The inclination device of claim 21, wherein the actuator is positioned near the second end of the support structure for lifting and lowering the second end of the support structure.

23. The inclination device of claim 22, including a lift assembly positioned between the actuator and the support structure.

24. The inclination device of claim 23, wherein the lift assembly is comprised of a scissor jack.

25. The inclination device of claim 21, including a bracket extending from the support structure, wherein the bracket is adapted to connect to the exercise machine.

26. The inclination device of claim 21, including a first bracket extending from near a first side of the support structure and a second bracket extending from near a second side of the support structure, wherein the first bracket is adapted to connect to a first side of the exercise machine and wherein the second bracket is adapted to connect to a second side of the exercise machine.

27. The inclination device of claim 21, wherein the support structure is comprised of a first support member and a second support member, wherein the first bracket extends upwardly from the first support member and wherein the second bracket extends upwardly from the second support member.

28. The inclination device of claim 21, including a plurality of first brackets extending upwardly from near a first side of the support structure and a plurality of second brackets extending upwardly from near a second side of the support structure, wherein the first brackets are adapted to connect to a first side of the exercise machine and wherein the second brackets are adapted to connect to a second side of the exercise machine.

* * * * *